US005308184A

United States Patent [19]

Bernard

[11] Patent Number: 5,308,184

[45] Date of Patent: May 3, 1994

[54] METHOD AND APPARATUS FOR MECHANICALLY JOINING CONCRETE-REINFORCING RODS

[75] Inventor: Alain Bernard, Marco-en-Baroeul, France

[73] Assignee: Techniport S.A., Marquette, France

[21] Appl. No.: 781,968

[22] Filed: Oct. 24, 1991

Related U.S. Application Data

[63] Continuation-in-part of Ser. No. 302,201, Jan. 27, 1989, Pat. No. 5,158,527.

[30] Foreign Application Priority Data

Jan. 4, 1991 [FR] France ..... 91 00595

[51] Int. Cl.[5] ..... F16B 7/18

[52] U.S. Cl. ..... 403/305; 403/307; 403/343; 52/726.1

[58] Field of Search ..... 403/301, 303, 305, 307, 403/308, 310, 313, 314, 300, 43, 47, 286, 343, 342, 360, 279, 306; 72/89; 29/452; 52/726.1

[56] References Cited

U.S. PATENT DOCUMENTS

| | | | |
|---|---|---|---|
| 50,190 | 9/1865 | Watson | 403/310 |
| 762,245 | 6/1904 | McGehee | 403/43 |
| 793,690 | 7/1905 | Snyder | 403/300 |
| 1,085,515 | 1/1914 | Wills | 403/343 X |
| 1,464,337 | 8/1923 | Price et al. | 403/314 X |
| 2,066,276 | 12/1936 | Harrall et al. | 403/314 X |
| 2,186,482 | 1/1940 | Frank | 403/307 |
| 3,327,380 | 6/1967 | Howlett | 403/307 X |
| 3,415,552 | 12/1968 | Howlett | 403/305 |
| 3,850,535 | 11/1974 | Howlett et al. | 403/305 |
| 4,143,986 | 3/1979 | Antosh | 403/307 |
| 4,241,490 | 12/1980 | Edward | 403/279 X |
| 4,362,423 | 12/1982 | Miles . | |
| 4,484,833 | 11/1984 | Gallagher, Jr. | 403/343 X |
| 4,500,224 | 2/1985 | Ewing | 403/343 |
| 4,752,151 | 6/1988 | Ashida et al. | 403/307 X |
| 4,769,886 | 9/1988 | Berchem et al. | 29/452 X |
| 4,799,307 | 1/1989 | Reigstad et al. | 29/452 |
| 4,819,469 | 4/1989 | Kies et al. | 72/89 |
| 4,850,777 | 7/1989 | Lawrence et al. | 403/305 X |
| 4,856,952 | 8/1989 | Shaw . | |
| 5,067,844 | 11/1991 | Bowmer et al. | 403/305 |

FOREIGN PATENT DOCUMENTS

| | | |
|---|---|---|
| 0190989 | 1/1986 | European Pat. Off. . |
| 0327770 | 8/1989 | European Pat. Off. . |
| 1750177 | 8/1957 | Fed. Rep. of Germany . |
| 1784807 | 11/1971 | Fed. Rep. of Germany . |
| 3122874 | 1/1983 | Fed. Rep. of Germany . |
| 8600406 | 6/1986 | Fed. Rep. of Germany . |
| 8803649 | 6/1988 | Fed. Rep. of Germany . |
| 1047189 | 12/1953 | France . |
| 1459978 | 11/1966 | France . |
| 2166317 | 8/1973 | France . |
| 2207232 | 6/1974 | France . |
| 2558904 | 8/1985 | France . |
| 2626600 | 8/1989 | France . |
| 8301358 | 11/1984 | Netherlands . |
| 1546253 | 5/1979 | United Kingdom . |
| 2227802 | 8/1990 | United Kingdom . |
| 8604384 | 7/1986 | World Int. Prop. O. . |
| 9008867 | 8/1990 | World Int. Prop. O. . |

OTHER PUBLICATIONS

Concrete, vol. 24, No. 7, Jul. 1990, London, pp. 16–20; Technical Bulletin, Couplers for Rebars to BS4449.

*Primary Examiner*—Randolph A. Reese
*Assistant Examiner*—Harry C. Kim
*Attorney, Agent, or Firm*—Sandler Greenblum & Bernstein

[57] ABSTRACT

A mechanical connection for concrete reinforcing rods has a connecting sleeve and a reinforcing rods having protuberances (e.g., ribs or fins) on their outer surfaces. Each of the reinforcing rods has a threaded end for connection with the connecting sleeve, which has tapped portions for receiving the reinforcing rods. In one embodiment, a first end of a first reinforcing rod is passed completely through the sleeve, and the sleeve is then rotated about the end while simultaneously being screwed onto a second end of a second reinforcing rod. Upon tightening the connecting sleeve, the ends of the first and second reinforcing rods are placed in substantially coaxial, end-to-end arrangement, and are rotationally immobile. In a preferred embodiment, the connecting sleeve comprises a sheath having a conical bore, together with a conical socket in the form of two shell halves, which, when place together, provide two internal tapped portions having opposing threads.

14 Claims, 5 Drawing Sheets

METHOD AND APPARATUS FOR MECHANICALLY JOINING CONCRETE-REINFORCING RODS

BACKGROUND OF THE INVENTION

1. Continuing Information

The present application is a continuation in part of patent application Ser. No. 07/302,201 filed in the United States on Jan. 27th, 1989, now U.S. Pat. No. 5,158,527.

2. Field of the Invention

It relates to improvements made to mechanical connections for concrete reinforcing rods. It concerns a mechanical connection for reinforcing rods, a connecting sleeve permitting the implementation of the said connection, a reinforcing rod permitting the implementation of the said connection, and a process for producing such a connection.

It will find an application in the field devoted to the construction of concrete buildings, elements or edifices.

3. Background and Relevant Information

In such a field, it is common to use mechanical connections to connect reinforcing rods in order to be able to ensure the transmission of tensile stress in a continuous manner.

For example, U.S. Pat. No. 5,158,527 proposes such a mechanical connection for reinforcing rods, wherein the reinforcing rods to be connected comprise at least one threaded end for insertion into a tapped connecting sleeve in order to permit substantially coaxial connection of the two concrete reinforcing rods.

According to U.S. Pat. No. 5,158,527, the mechanical connection for concrete reinforcing rods comprises at least:

a connecting sleeve having at least one cylindrical internal tapped portion, a concrete reinforcing rod to be connected having a nominal cross-section "Φ" and at least one end to be connected, the said end to be connected having at least one area reinforced by cold upsetting, and a threaded cylindrical portion, corresponding to the said tapped portion, the said reinforced area having a reinforced cross-section with a diameter "$d_1$" greater than the said nominal cross-section "Φ", the said threaded portion having a bottom of thread diameter "$d_2$", and being provided on the said reinforced area such that diameter "$d_2$" is equal to or greater than the nominal cross-section "Φ".

The presence of this upset portion makes it possible to increase the tensile strength of the said end as it makes it possible to obtain a cross-section for the reinforcing rod at the bottom of thread of the threaded end at least equal to or greater than the nominal cross-section of the reinforcing rod connected. Such a design gives good results both with regard to mechanical strength and with regard to the cost price, deriving on one hand from simplicity of implementation and, on the other hand, from a saving in material.

This being the case, a threaded mechanical connection is of interest but necessitates in certain cases the production of a sleeve with double threading, one a right-hand thread, the other a left-hand thread, in order to permit connection without it being necessary to displace one of the reinforcing rods in rotation.

This is essential when a reinforcing rod sunk in the concrete has to be connected to a rod with an elbow or the longitudinal axis of which is not rectilinear, as it is then materially impossible to cause the rod to rotate about the connection axis.

This is, for example, also the case when it is necessary to connect two reinforcing cages each formed of reinforcing rods, disposed parallel to one another, and joined by transverse wires.

While it is conceivable to displace a single rod at the time of connection, it becomes completely impossible in such connecting operations to provide for even slight rotation of rods connected to one another by the pins.

That is why, in certain cases, constructors use crimped sleeves, wherein connection can be made without having to rotate one of the reinforcing rods.

The latter technique uses a socket into which are fitted the two ends of the reinforcing rods, the socket then being crimped onto the reinforcing rods by means of a jack and a press.

However, the aforenamed technique is criticized in that it presents high risks of slippage owing to the fact that crimping is difficult to measure. Furthermore, it is often difficult to implement on site as it has to be possible to operate with crimping tools at the point where connection is to be made.

Furthermore, it should also be noted that, as regards connections for reinforcing cages, there are sometimes found to be differences in the levels of the ends of the reinforcing rods, as well as axial differences between rods of two successive cages. These two sources in accuracy still further complicate the interconnection of such cages.

SUMMARY OF THE INVENTION

The object of the present invention is to provide improvements to mechanical connections for reinforcing rods so that they can overcome the aforementioned drawbacks, by permitting, in particular, the connection of reinforcing rods, positioned in relation to one another, and practically and/or completely rotationally immobile.

One of the objects of the present invention is to provide a mechanical connection for reinforcing rods that encompasses notably all the advantages in respect of mechanical strength of that described in U.S. Pat. No. 5,158,527 and that permits an extension of this technique to the connection of reinforcing cages constituted by several reinforcing rods that are mutually positioned and immobilized. However, the improvements made to the mechanical connection can also be applied to the connection of two reinforcing rods that are not subject to the requirements of rotation.

According to the present invention, the mechanical connection for reinforcing rods, which will find an application particularly in the field of concrete element construction, for connecting at least two reinforcing rods, wherein the reinforcing rods comprise, on one hand, ribs or fins on their outer surface and, on the other hand, each at least a threaded end, designed to be inserted into a connecting sleeve having tapped portions, is characterized by the fact that it has means for allowing the end of the first rod to be connected to be passed completely through the sleeve, and for allowing the rotation of the sleeve about the end of the said first reinforcing rod and, simultaneously, its screwing, directly or indirectly, onto the end of the second reinforcing rod, the said ends of the said first and second rods being placed substantially coaxially, substantially end to end, and rotationally immobile or practically immobile.

The process for producing mechanical connections for reinforcing rods according to the present invention is characterized by the fact that:

the end of the first reinforcing rod to be connected is passed completely through the sleeve, the ends of the said first and second rods are placed substantially coaxially, substantially end to end, the said rods being rotationally immobile, the two reinforcing rods are connected by rotating the sleeve about the end of the said first rod and the sleeve is screwed, directly or indirectly, to the end of the other rod to be connected, the said sleeve having at least a first and a second tapped portion corresponding to the said threaded ends of the rods to be connected.

In this connection, one of the objects of the present invention is to provide a process for the production of mechanical connections for reinforcing rods, and such a mechanical connection, as well as reinforcing rods and sleeves permitting same, which will find an application in particular in the field devoted to the construction of concrete elements or edifices, wherein the reinforcing rods are connected by screwing with the help of tapped connecting sleeves, which make it possible to encompass the advantages of the connection covered by the main patent and which combine the advantages of traditional crimped connections, without inheriting their drawbacks.

This being the case, one of the objects of the improvements of the present invention is to provide a process for the production of a mechanical connection for reinforcing rods, and such a mechanical connection, which can be used with a rod already sunk in concrete, and whatever the configuration of the other rod to be connected, complete rotation of the rods not being necessary.

According to a first form of embodiment of the present invention, the mechanical connection for concrete reinforcing rods, which will find an application particularly in the concrete element construction field, wherein the reinforcing rods to be fixed comprise, on one hand, ribs or fins on their external surfaces and, on the other hand, an end designed to be inserted into a tapped connecting sleeve, is characterized by the fact that at least one of the ends of the reinforcing rod, reinforced by upsetting, is provided such that the said sleeve can be completely screwed thereonto, despite the presence of the said ribs or fins.

In this case, the process for the production of mechanical connections for reinforcing rods according to the present invention is characterized, in a first form of embodiment, by the fact that the upsetting is carried out in such a way that its diameter is greater than or equal to the diameter of the end of the reinforcing rod including the ribs or fins.

In another form of embodiment of the invention, the upset end or ends is/are threaded and the thread is also provided on at least one portion of the ribs or fins of the end of the rod.

Finally, the reinforcing rod, obtained by implementing the process of the present invention, is noteworthy in that the upsetting diameter of the end is such that the bottom of thread diameter of the said end under consideration is greater than or equal to the outside diameter of the reinforcing rod including the said ribs or fins.

This being the case, when the said sleeve is unscrewed, to re-screw it onto the end of the other reinforcing rod, as described previously, it is sometimes necessary, not to rotate the rod entirely, but to cause it to rotate slightly, a quarter turn or a half turn to permit simultaneous rotation of the sleeve on the two threaded ends. This slight displacement is necessitated by the probable disalignment between the two threads which are provided on two different elements.

However, in certain cases, even a slight rotation of the reinforcing rod is impossible, as, for example, when connecting reinforcing cages.

Another object of the present invention is to provide a mechanical connection sleeve for reinforcing rods that can be applied to the junction of such rods the ends of which are threaded, while permitting this connection without it being necessary to rotate the latter.

A particular application of the sleeve according to the present invention is to be found, notably, in the joining of reinforcing cages in which the rods are rotationally immobile by their very construction.

Furthermore, the sleeve of the present invention will make it possible to make up for the different levels of the reinforcing rods forming these cages, as well as certain alignment defects affecting rods in two successive cages.

Furthermore, the present invention enables a mechanical connection for reinforcing rods to be produced wherein the sleeve, via the threaded ends of the reinforcing rods, transmits the compressive stresses. Indeed, according to the connection of the invention, the threads can be placed under traction.

Another object of the present invention is to provide a process for the production of mechanical connections for reinforcing rods that is particularly advantageous as it facilitates assembly and makes it possible to avoid having recourse to crimped sleeves, thus obviating all their drawbacks.

The present invention also provides in this connection a connecting sleeve and/or a reinforcing rod permitting the production of such a mechanical connection for reinforcing rods.

The connecting sleeve according to the invention has a first tapped portion suitable for being screwed, directly or indirectly, onto the end of the said first rod to be connected, and a second tapped portion, suitable for being screwed, directly or indirectly, onto the end of the said second rod to be connected, the said first and second tapped portions being such that, on one hand, at least one of the said first and/or second tapped portions provides a possibility of rotation in relation to the sleeve and, on the other hand, they permit longitudinal deflection to adjust for the threads of the two said ends.

According to one of the forms of embodiment, the said sleeve is constituted by a sheath emprisoning a socket permitting the said rotation and the said longitudinal deflection. In another form of embodiment, the sleeve is constituted by a sheath having a conical bore inside which is provided a conical socket in several parts permitting the said rotation and the said longitudinal deflection.

Furthermore, the connection production process according to the present invention uses advantageously, but this is not essential, reinforcing rods the ends of which are cold upset and threaded, in order to increase the strength of the mechanical connection.

Brief Description of the Drawings

The present invention will be more readily understood from studying the following description which is given, however, only by way of illustration, and is not intended to limit it, accompanied by the annexed drawings, which form an integral part thereof.

Detailed Description of the Invention

The invention relates to improvements to mechanical connections for concrete reinforcing rods.

More precisely, the invention relates to a mechanical connection for reinforcing rods, a connecting sleeve permitting the production of the said connection, a reinforcing rod permitting the implementation of the said connection, and a process for producing such a connection.

The present improvements have been developed especially to avoid rotating the reinforcing rods to be connected when implementing the said connection. However, it can also be applied to the production of mechanical connections for reinforcing rods in which it is possible to rotate the said rods.

Figure 1:
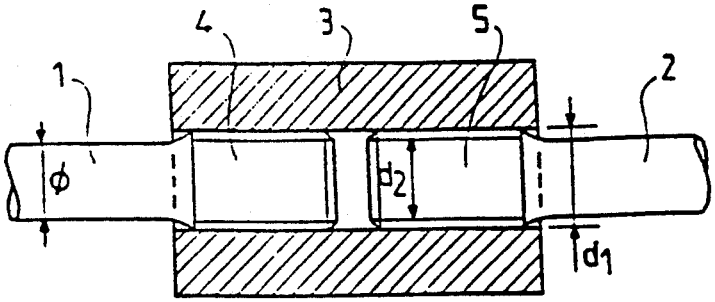
FIG. 1 represents the principle used for connecting two reinforcing rods, according to U.S. Pat. No. 5,158,527.

It should be remembered that, according to U.S. Pat. No. 5,158,527, and as illustrated in FIG. 1, a mechanical connection makes it possible, in particular to ensure the fixing of two reinforcing rods, 1 and 2, end to end, substantially coaxially. For this purpose, use is made of a tapped connecting sleeve 3, suitable for receiving respectively, on one hand, the threaded end 4 of a first reinforcing rod 1 and, on the other hand, the end 5 of a second reinforcing rod 2.

Although such a connection can be contemplated with reinforcing rods the ends of which are threaded directly in the nominal cross-section of the rod, it may be advantageous to make use of the teachings of U.S. Pat. No. 5,158,527 to increase the tensile strength of the connection, for the same nominal cross-section of reinforcing rod to be connected.

In this case, the ends 4, 5 of reinforcing rods 1, 2 are reinforced in such a way that they are stronger than the central portion of the bar. Thus, at the time of threading, the end is not rendered fragile in relation to the nominal diameter of the bar.

More precisely, the connection comprises at least:

a connecting sleeve 3 having at least one cylindrical internal tapped portion a concrete reinforcing rod 1; 2 to be connected having a nominal cross-section "Φ" and at least one end to be connected 4; 5, the said end to be connected 4; 5 having at least one area reinforced by cold upsetting, and a threaded cylindrical portion, corresponding to the said tapped portion, the said reinforced area having a reinforced cross-section with a diameter "$d_1$" greater than the said nominal cross-section "Φ", the said threaded portion having a bottom of thread diameter "$d_2$", and being provided on the said reinforced area such that diameter "$d_2$" is equal to or greater than the nominal cross-section "Φ".

In particular, if the symbol Φ is used to designate the nominal cross-section of the reinforcing rod to be connected, the upset end will then have an outside diameter $d_1$ such that the cross-section of the reinforcing rod at the bottom of thread $d_2$ is at least equal to or greater than the nominal cross-section Φ, as shown in particular in FIG. 1.

More precisely, prior to threading, ends 4 and 5 of reinforcing rods 1 and 2 to be connected are subjected to cold upsetting respectively; then the upset ends 4 and 5 are respectively threaded, in accordance with perfectly conventional threading techniques, notably by cutting.

Furthermore, the said threaded portion provided on the said reinforced area has a length corresponding substantially to the dimension of the said nominal cross-section "Φ".

Moreover, the said reinforced area corresponding to a rate of increase $(d_1-\Phi/\Phi)$ of the said nominal cross-section Φ of the reinforcing rod is equal to or less than 30%. In addition, the said reinforced cross-section "$d_1$" is all the greater the smaller the said nominal cross-section "Φ", the increase between the two said cross-sections "Φ" and "$d_1$" corresponding at least to the depth of the threaded portion "$d_t$"$=(d_1-d_2)/2$.

Finally, the said reinforced area bearing the said threaded portion is advantageously pre-stressed, prior to the assembly of the said connection on site, to pass the tensile tests required by certain safety standards.

As regards the threaded and tapped portions, according to the different forms of embodiment proposed below, use will be made either of two identical threads, right-hand or left-hand, or of two opposed threads, one right-hand and the other left-hand.

Hitherto, the use of opposed threads, one right-hand and the other left-hand, was essential in order to effect a connection between two reinforcing rods without rotating them. However, it is to be noted that, in certain cases, it is essential, as mentioned earlier, to effect a slight rotation, a quarter turn or a half turn, to permit simultaneous rotation of the sleeve over the two threaded ends to restore the correspondence of the two threads.

The present invention makes it possible to provide a solution for these drawbacks, which also makes it possible to avoid having recourse to known crimping solutions, which are open to criticism.

Figure 2A:
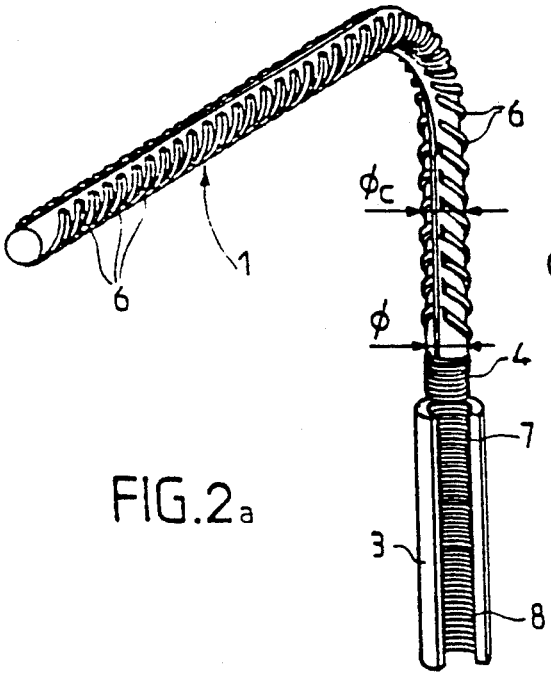
FIGS. 2*a* to 2*c* provide perspective views of the different stages in the process for connecting reinforcing rods, according to a first form of embodiment of the invention, wherein the end of the rod is bent.
Figure 2B:
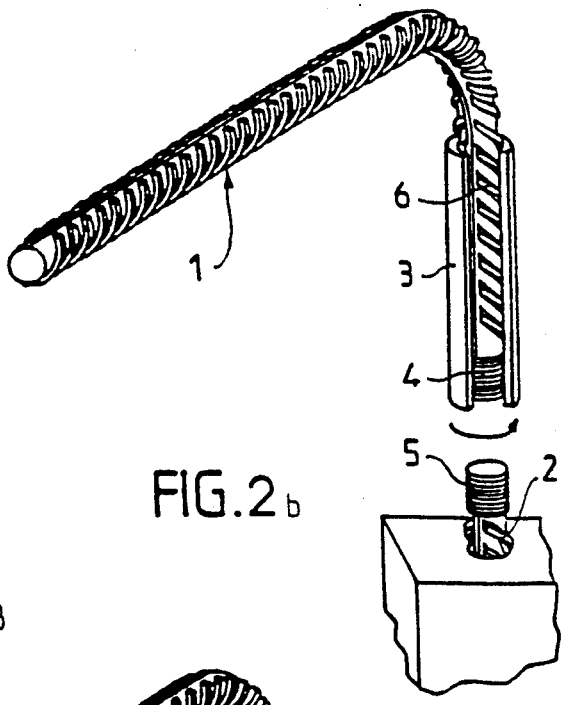
Figure 2C:
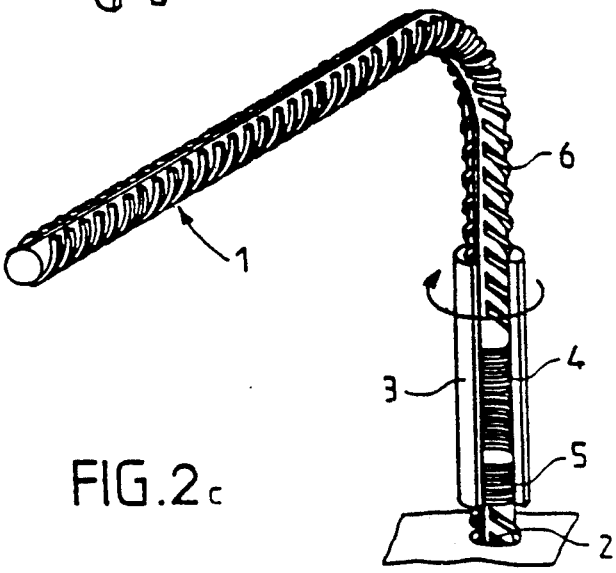
Figure 3:
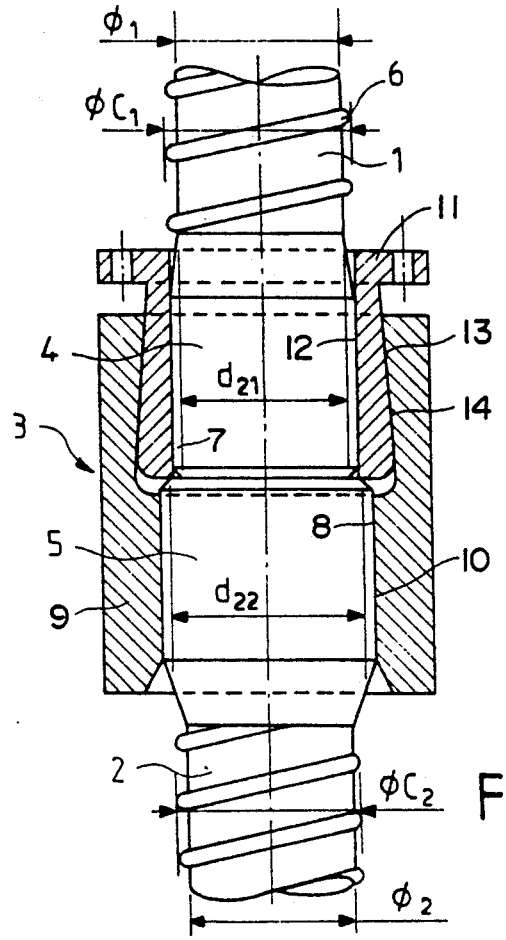
FIG. 3 shows a second form of embodiment of the mechanical connection for reinforcing rods according to the present invention.
Figure 4:
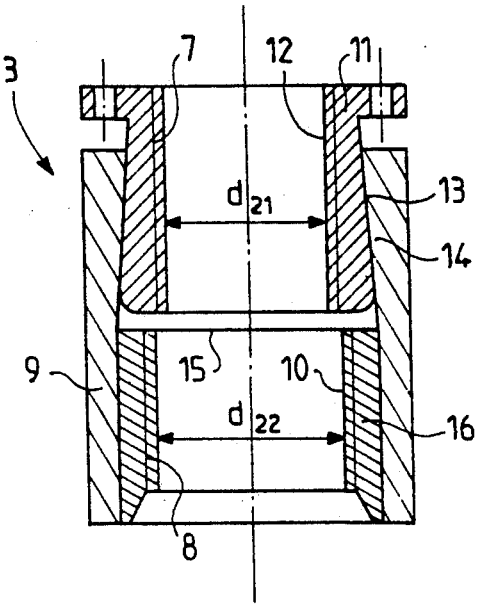
FIG. 4 shows the tapped connecting sleeve designed for the connection as represented in FIG. 3.

Generally, as shown in particular in FIGS. 2 to 4, reinforcing rods 1, 2 have on their outer surfaces, ribs 6 or fins which thus create protuberances permitting the translation immobilisation of the rod in the concrete when it is sunk therein.

Such reinforcing rods are commonly used and sometimes shaped or bent, but they are also used in producing reinforcing cages constituted by an assembly of reinforcing rods joined together and mutually immobilized by transverse pins. Thus, if it is desired to accomplish the connection of two rods in the prolongation of one another, it is practically impossible, or even quite impossible, to rotate the rod in question.

That is why, according to the present invention, the mechanical connection for reinforcing rods has means for allowing end 4 of the first rod for connection to be passed completely through sleeve 3, and for enabling sleeve 3 to rotate about end 4 of the said reinforcing rod 1, and, simultaneously, for it to be screwed, directly or indirectly, onto end 5 of second reinforcing rod 2, the said ends 4, 5 of the said first and second rods, 1, 2, being placed substantially coaxially, substantially end to end, and rotationally immobile, as shown in particular in FIGS. 2 to 12, as well as the different successive stages in the production of the connection, as shown in FIGS. 2, 5 and 10.

This characteristic of the connection of the present application is an advantage as it practically no longer, or even no longer in fact, necessitates any relative rotary movement of the two rods.

This being the case, the mechanical connection of the present invention, and more precisely the said means for allowing passage, and then the said rotation, and screwing, take the form of a sleeve 3, the different variants of which are illustrated in FIGS. 2 to 12, bearing a first tapped portion 7; 17; 27; 37, suitable for being screwed, directly or indirectly, onto end 4 of the said first rod to be connected 1, and a second tapped portion 8; 18; 28; 38, suitable for being screwed, directly or indirectly, onto end 5 of the said second reinforcing rod 2.

Furthermore, in the case of certain forms of embodiment, such as those in FIGS. 3 to 12, the said first 7; 17; 27; 37 and second 8; 18; 28; 38 tapped portions are designed in the region of the sleeve such that, on one hand, at least one of the said first and/or second tapped portions allows for the possibility of rotation in relation to sleeve 3 and, on the other hand, they permit longitudinal deflection to adjust for the threads of the two said ends 4, 5.

Thanks to this arrangement, it will be possible to connect together two reinforcing rods that are completely rotationally immobile, sleeve 4 then making it possible to adjust for any lack of correspondence between the threads of the two ends and, furthermore, to adjust for any level differential between the two said ends.

This being the case, according to the first form of embodiment shown in FIGS. 2*a–c*, at least one of the ends 4, 5 of the reinforcing rod, previously reinforced by the said upsetting, is provided such that the said sleeve 3 can be screwed completely thereonto, despite the presence of the said ribs 6 or fins. This is illustrated, in particular, in FIG. 2*b*.

Thus, when reinforcing rods are to be connected, for example, a rod 2 already sunk in the concrete, hence rotationally and translationally immobilized, and another reinforcing rod 1, difficult or even impossible to rotate, sleeve 3 is screwed completely onto the end to be connected 4, then the two ends 4, 5 to be connected are placed substantially coaxially and, finally, sleeve 3 is unscrewed from end 4, thus permitting its screwing over end 5 for connection, as illustrated in particular in FIG. 2*c*.

In this case, only the sleeve is rotated, and the two rods remain fixed, except for the fact that they are brought closer together.

Such a technique is advantageous as it is possible to pre-sink the reinforcing rod in its solid block, and then protect the thread, for example using a protective metallic screw-on cap.

In a variant of this first form of embodiment of FIGS. 2, the upsetting diameter of end $d_1$ is such that the bottom of thread diameter $d_2$ of the threaded portion of the said end under consideration is greater than or equal to the outside diameter $\Phi c$ of the reinforcing rod including the ribs or fins.

For this purpose, at the time of producing the reinforcing rod under consideration, the upset portion will be made such that it is greater than or equal to the diameter $\Phi c$ of the end of the rod including the ribs or fins.

In another form of embodiment, instead of providing for the upsetting diameter as a function of the rod diameter, the upset end or ends will be threaded, but this threaded portion will also be prolonged over at least one part of ribs 6 or fins of the end of the said rod.

Thus, the reinforcing rod will have at its end the said threaded portion of the upset end, prolonged by as much on the said ribs 6 or fins.

This being the case, in these two alternative forms of embodiment, connecting sleeve 3 can comprise only one type of thread, notably a right-hand thread, without it being necessary to have opposed threads, to avoid rotating the reinforcing rods at the time of their connection. In other words, the said first tapped portion 7 and the second tapped portion 8 will be identical and one and the same.

In the case of FIGS. 2, sleeve 3 is screwed completely onto end 4 for connection, then the sleeve is unscrewed from its end 4 to be re-screwed onto end 5 of the other rod, 2, in order to effect the connection.

By way of a non-limitative example, for a concrete rod having a nominal section of 32 mm and an outside diameter including ribs of approximately 35 mm, an upset portion was effected with a diameter $d_1$ of 36 mm with a fine thread of 300 over a length of approximately 35 mm, and then the threaded portion was extended over approximately 140 mm to level off ribs 6 of the rod, and allow complete screwing onto the rod of a connecting sleeve of approximately 175 mm in length, with M36 tapping and a fine thread of 300.

Figure 6:
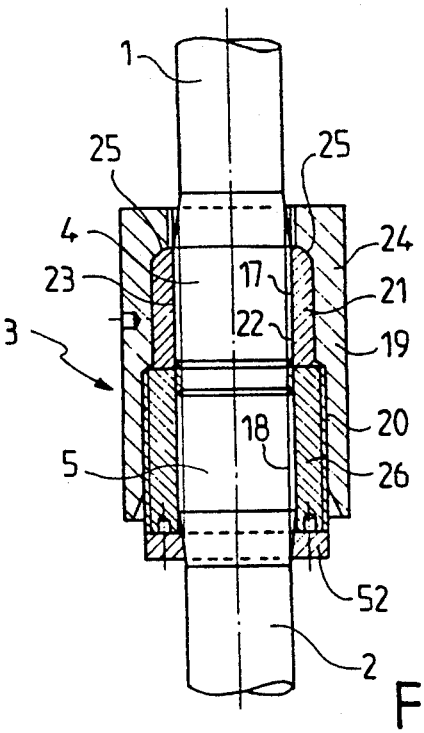
FIG. 6 is a schematic cross-sectional view of a third form of embodiment of a mechanical connection for reinforcing rods according to the present invention.

FIGS. 3 and 6 show a second type of connection wherein the said sleeve is formed by a sheath 9; 19 the bore of which has a first threaded cylindrical portion 10; 20 constituting the second tapped portion 8; 18, as well as a second portion 14; 24 emprisoning a socket 11; 21.

The said socket 11; 21 has internally a cylindrical portion 12; 22 on which is provided the said first tapped portion 7; 17. Furthermore, the outer face 13; 23 of the socket permits its rotation in relation to sheath 9; 19 and its longitudinal blocking in relation to the sheath, as well as the said longitudinal deflection.

This being the case, there can advantageously be provided at least one of ends 4 of the first reinforcing rod 1, pre-reinforced by the said upsetting, such that the said sleeve 3 can be screwed completely thereover, despite the presence of the said ribs 6 or fins. This is illustrated, in particular, in FIGS. 5*b* and 5*c*.

More precisely, in an alternative form of embodiment, upsetting diameter $d_{11}$ of the end is such that bottom of thread diameter $d_{21}$ of the threaded portion of the said end 4 in question is greater than or equal to diameter $\Phi C_1$ of the reinforcing rod including ribs 6 or fins. This is illustrated, in particular, in FIG. 5*a*.

In another alternative form of embodiment, instead of designing the upsetting diameter as a function of the diameter of the rod including the ribs, the threading is provided over upset end 4, but this threaded portion will also be extended over at least one part of the ribs 6 or fins of the end of said reinforcing rod 1. Thus, the reinforcing rod will have at its end the threaded portion of the upset end prolonged by as much over the said ribs 6 or fins.

In the third form of embodiment, as illustrated in FIG. 4, the said cylindrical portion 10 is prolonged by a truncated cone 14, the larger base 15 of which faces cylindrical portion 10. Socket 11 is, for its part, designed to cooperate with the truncated cone 14 of the sheath, i.e. it has at least one frustoconical portion 13, the conicity of which corresponds to that, 14, of sheath 9, and the larger base 16 of which is smaller in size than that of sheath 9.

It should be noted that, if socket 11 and the sleeve are not produced by forging, an intermediate ring 16 will then be provided which will permit the introduction of socket 11.

As regards the respective tapped portions 7 and 8 of the sleeve, according to the principle previously explained, it must be possible for the sleeve to be passed completely over the end 4 of the first reinforcing rod 1 to be connected.

Thus, socket 11 bears a tapped portion 7 corresponding to the bottom of thread diameter $d_{21}$ of the threaded portion of end 4 of the first rod to be connected, this diameter $d_{21}$, it should be remembered, being greater than or equal to the outside diameter $\Phi C_1$ of the concrete reinforcing rod 1 including the ribs or fins, or else the threaded portion of the upset end 4 of the first rod 1 is prolonged by as much, according to the sleeve, over the said ribs or fins 6.

Furthermore, also to permit complete passage over the first reinforcing rod, the said second tapped portion 8 must be at least equal to or greater than the first tapped portion 7.

In other words, the threaded portion of end 4 of the first reinforcing rod 1 is equal to or less than that of end 5 of the second reinforcing rod 2 ($d_{21} \geqq d_{22}$).

However, advantageously, to facilitate the putting into place of the connection, the threaded portion and/or the upset portion of end 5 of the second rod 2 is greater than that of end 4 of the said first rod 1, as illustrated in particular in FIG. 4.

This being the case, to produce a mechanical connection for reinforcing rods, as described in U.S. application Ser. No. 07/302,201, U.S. Pat. No. 5,158,527, cold upsetting is carried out at the different ends 4, 5 of reinforcing rods 1, 2 advantageously over a length corresponding to that of the threaded portion.

Furthermore, in order to be able to pass and, in the case in point, screw sleeve 3 completely over end 4 of the first rod 1, either end 4 is upset such that it is greater than or equal to the outside diameter $\Phi C_1$ including the ribs or fins, or the threaded portion of end 4 is prolonged over at least one portion of the ribs 6 or fins of the said end 4.

Figure 5A:
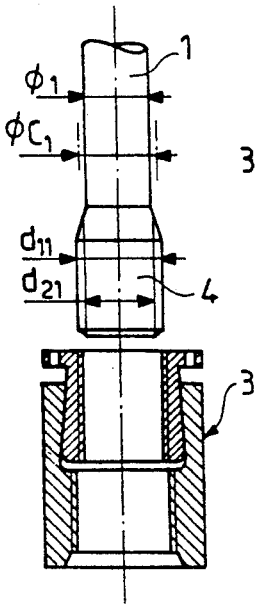
FIGS. 5*a, b, c, d* show the different stages in the implementation of the reinforcing rod connection according to the present invention.
Figure 5B:
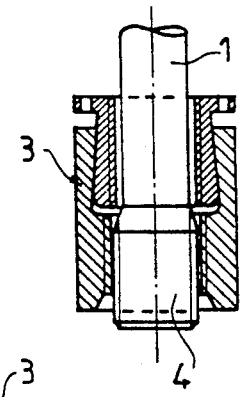
Figure 5C:
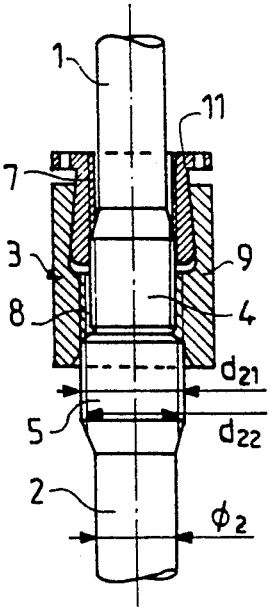
Figure 5D:
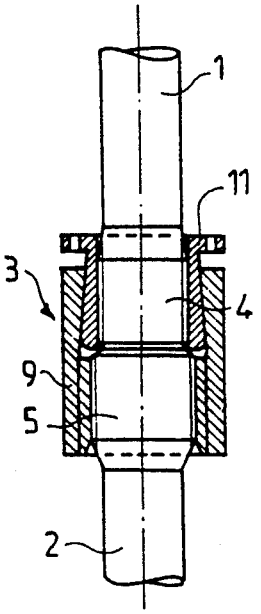

The procedure for forming the connection is then carried out according to the different steps, as shown in FIGS. 5*a* to 5*d* and, in particular:

sleeve 3 is screwed completely over one of the ends to be connected, i.e., in the present case, end 4 of the first rod 1, ends 4, 5 of the rods 2 to be connected are placed substantially coaxially and substantially end to end, as shown in FIG. 5*c*, the two rods 1, 2 are connected by subsequently unscrewing, at least partially, sleeve 3, which then screws onto the other of the ends to be connected, in the case in point end 5 of the second reinforcing rod 2.

When sleeve 3 has been screwed completely onto end 4 of rod 1, in accordance with the characteristics described above, either sleeve 3 is slidable on end 4 of the reinforcing rod, as the dimensions of the threaded end 4 are less than the dimensions of tapped portion 8 and the dimensions of tapped portion 7 are greater than the cross section $\Phi C_1$ of the rod, or the sleeve 3, or more precisely, socket 11, is screwed over the threaded portion extended over ribs 6 of rod 1, as shown in particular in FIG. 5*b*.

After the two ends, 4 and 5, have been placed end to end, when the movement of unscrewing sleeve 3 from rod 1 commences, the threaded portion 4 will engage with tapped portion 7, and threaded portion 5 will engage with tapped portion 8.

The relative mobility between socket 11 and sheath 9 will permit the automatic adaptation and matching of the threads, at the same time maintaining the two ends 4 and 5 in abutment, and without absolutely necessitating the rotation, even slightly, of the two rods in relation to one another.

Once this adaptation to the thread has been made, the screwing of socket 11 onto end 4 and of sheath 8, 9, 10 onto end 5 will be synchronized, any difference in this thread pitch being compensated for by relative rotation of the two truncated cones, 13 and 14.

When the connection has been installed, i.e. when the ends 4 and 5 are respectively screwed into the tapped portions 7 and 8, the connection is tightened until the socket 11 is locked longitudinally and prevented from sustaining any deflection in relation to the sheath, by blocking the two truncated cones 13, 14. This is obtained, for example, by relatively positioning end 5 in abutment in relation to socket 11, as shown, in particular, in FIG. 5*d*.

In this respect, it should be noted that the said socket 11 and sheath 9 advantageously have independent gripping means enabling the connection to be tightened.

Such a connection will permit the joining of reinforcing cages wherein the rods are rotationally immobilized in relation to one another in the same cage and whereof rotation is impossible from one cage to another.

By way of a non-limitative example, for the purpose of connecting HA50 high adherence concrete reinforcing rods, the end 4 of the first rod 1 was subjected to upsetting, to enable an M56 threaded portion to be produced, while the second rod, 2, was subjected to upsetting to enable its end to be provided with an M64 thread.

FIG. 6 shows a third form of embodiment similar to that illustrated in FIG. 4.

In this case, sleeve 3 is constituted by a sheath 19 having two cylindrical faces, numbered 20 and 23. More precisely, the said tapped cylindrical portion 20 is prolonged by a second, smooth cylindrical portion 23 defining a shoulder 25 in sheath 19 and the outside dimensions of which coincide with those of the said socket 21 to allow the said rotation.

Furthermore, as illustrated in particular in FIG. 6, the said first cylindrical portion 20 comprises a removable internal ring 26 capable of being immobilized in the sleeve, and more precisely in sheath 19, the dimensions of which are such as to allow the inclusion in sheath 19, notably in the region of face 23, of the said socket 21.

The process for manufacturing such a connection is very similar to that described previously, i.e.:

end 4 of the first rod 1 to be connected is passed completely through sleeve 3 and, notably sheath 19, socket 21 is screwed, via the tapped portion 17, provided internally in the bore of socket 21, onto end 4, intermediate ring 26 is screwed onto end 5, via the said second tapped portion 18, provided internally in the bore of ring 26, ends 4, 5 of the said first and second rods, 1, 2, are placed substantially coaxially, and substantially end to end the two reinforcing rods, 1, 2 are connected by rotating sheath 19 about end 4, 21 and sheath 19 is screwed onto end 5 of the other rod via intermediate ring 26 and its corresponding external threaded portion.

Furthermore, the positioning of the said ends of the first and second reinforcing rods is adjusted by rotating at least one of the two said first and/or second tapped portions and the said tapped portion is blocked in the sleeve when the connection is screwed.

During screwing, if the two threads of the threaded portions of ends 4 and 5 are not matched, this is compensated for through the said rotation allowed socket 21 in sleeve 19.

When sleeve 19 has finished being screwed onto end 5, ring 26 comes into abutment with socket 21, locking and immobilizing the latter. Connection is thus achieved.

Figure 10A:
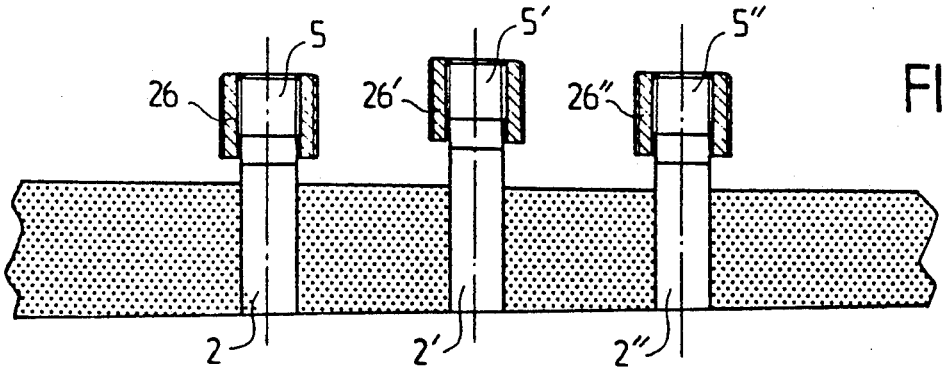
FIGS. 10*a* to 10*c* illustrate the process for connecting two reinforcing cages, each formed by reinforcing rods positioned in relation to one another and rotationally immobilized, in its different stages, using the connecting principle as illustrated in FIG. 6.
Figure 10B:
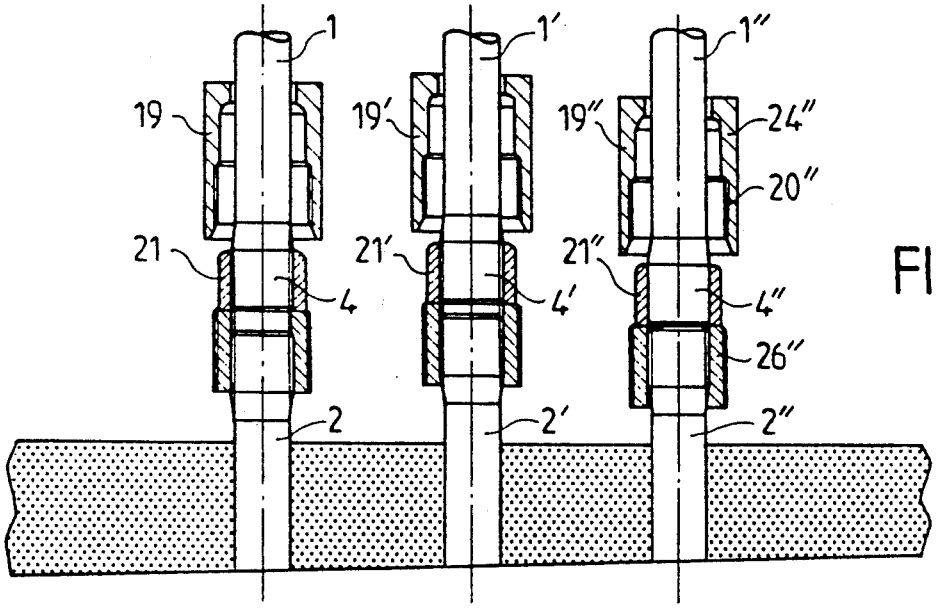
Figure 10C:
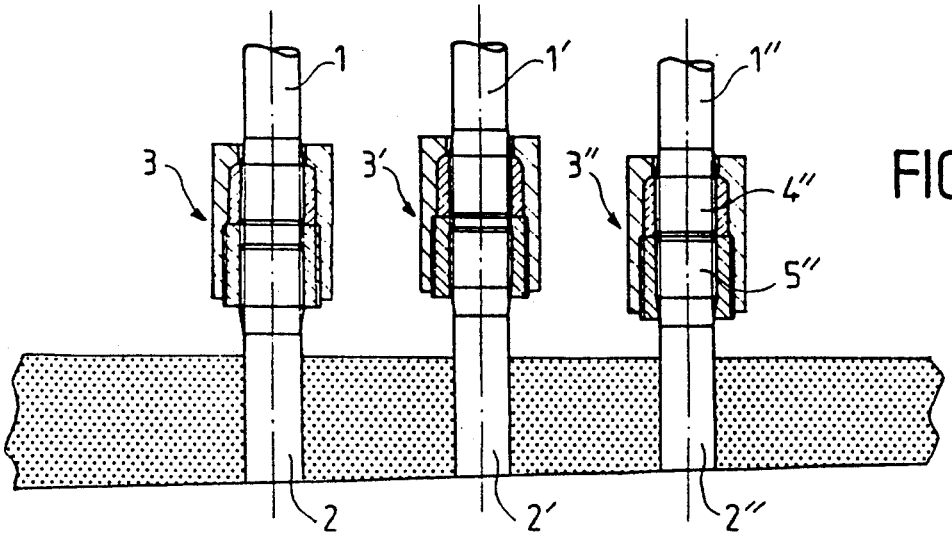
Figure 11:
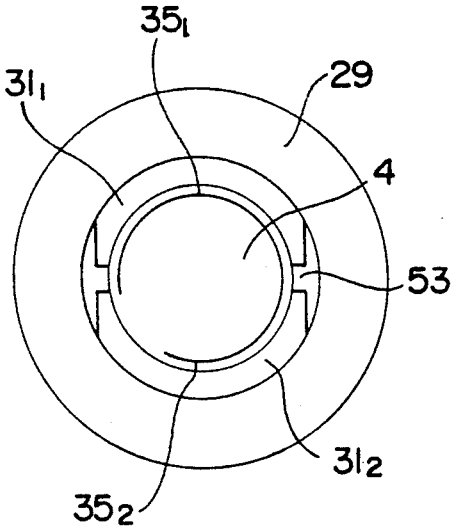
FIG. 11 represents a top view of the connection of FIG. 7.
Figure 12:
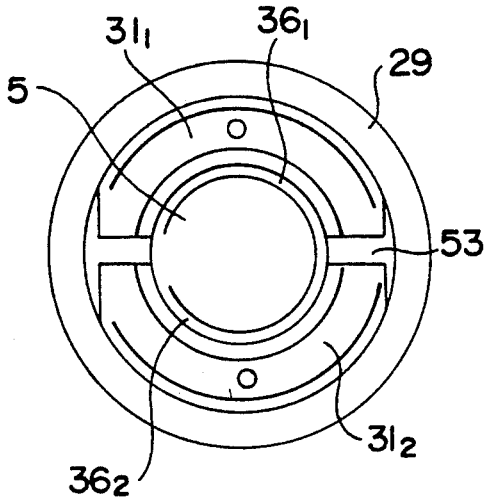
FIG. 12 is a bottom view of the connection of FIG. 8.

FIGS. 10*a* to 10*c* illustrate the process producing a connection that has just been described and show, in particular, the possibility of adjusting for gaps between rods at different levels.

In this connection, the reference numbers concerning the first connection on the left-hand side of the drawing correspond to those of the preceding description, while the other two rods have respectively the same numbers bearing "prime" and "second" signs.

FIG. 10*c* shows the connection of the two rods 1" and 2" wherein the ends 4" and 5" are in abutment with one another. On the other hand, more significant gaps between ends are illustrated in the case of connections 1–2 and 1'–2'.

At shoulder 25 will advantageously be provided a rounded shape permitting good stress distribution. In addition, the contact of socket 21 on intermediate ring 26 ensures that the compressive stresses are taken up and enables the sleeve to be locked.

Furthermore, it is to be noted that a lock-nut can be provided, notably as illustrated in FIG. 6, which will enable the threads to be placed under traction, by the tightening of the lock-nut, to transmit the compressive stress.

For this purpose, there must be abutting contact, at the ends of the reinforcing rods, or at the portions screwed thereonto, 21, 26, this being after tightening the lock-nut.

With regard to locking, to enable the different elements to be tightened, the connection, and more precisely sheath 19 and intermediate ring 26 have independent gripping means enabling the connection to be tightened.

Furthermore, taking account of the different relative movements of the elements possible, tightening will be facilitated by choosing the threads as follows:

end 4 of first reinforcing rod 1: left-hand thread,
end 5 of second reinforcing rod 2: left-hand thread,
tapped portion of sheath 19: right-hand thread,
external threaded portion of ring 26: right-hand thread,
tapped portion of ring 26: left-hand thread,
tapped portion of lock-nut: left-hand thread.

Of course, the converse solution could also be adopted, i.e. by replacing the right-hand threads by the left-hand threads, and vice versa.

By implementing such an arrangement, when sheath 19 is screwed, socket 21 and ring 26 will tend to come together. Indeed, as sheath 19 is screwed, for example, by turning towards the left, intermediate ring 26 is unscrewed in this direction from rod 2, and this ring is brought into abutment on socket 21.

It should be noted that, in the description, with reference to FIG. 6, there is provided an intermediate ring 26; in this case, the two ends 4 and 5 of the reinforcing rods have identical threading. However, one could contemplate, as for example in the case of FIG. 3, providing one of ends 5 with a larger diameter and threading.

Furthermore, the arrangement as represented in FIG. 6 advantageously enables adjustment to be made for a certain angle between two reinforcing rods to be connected, and a certain axial deflection of the ends of these two rods.

Indeed, as shown, in particular, in FIG. 10*b*, by providing the diameter of socket 21 so as to be less than the diameter of the internal tapped portion of sheath 19, and, additionally as a function of the respective lengths of socket 21 and of the said internal tapped portion, if there is an axial disalignment between rods 1" and 2", for example, when sheath 19" is lowered and when one begins screwing it onto ring 26", socket 21" will be located in portion 20" of the sheath, and screwing will commence with an axial disalignment of rods 1" and 2". In proportion as screwing progresses, and thanks to the forms imparted to the socket and to the bore of the sheath, socket 21" will take up position in portion 24" of the sheath, at the same time taking up the angular disalignment and restoring, notably by deformation of the rod, rod 1" and rod 2" to alignment, as shown in FIG. 10*c*.

Figure 7:
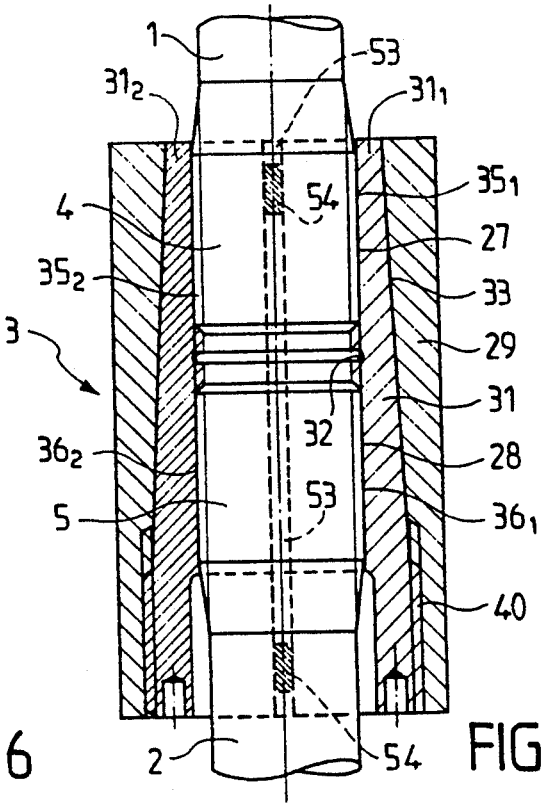
FIG. 7 is a schematic cross-sectional view of a fourth form of embodiment of a mechanical connection for reinforcing rods according to the present invention.
Figure 8:
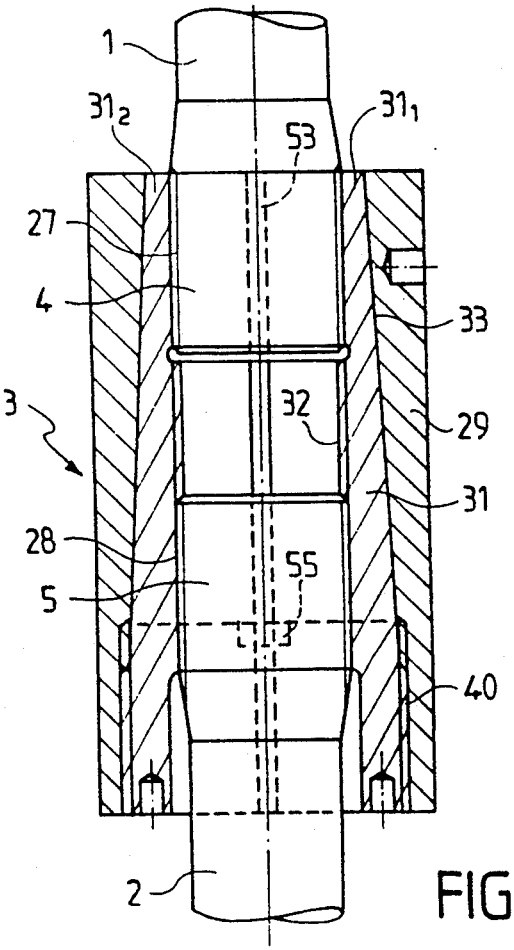
FIG. 8 is a schematic cross-sectional view of a fifth form of embodiment of a mechanical connection for reinforcing rods according to the present invention.
Figure 9:
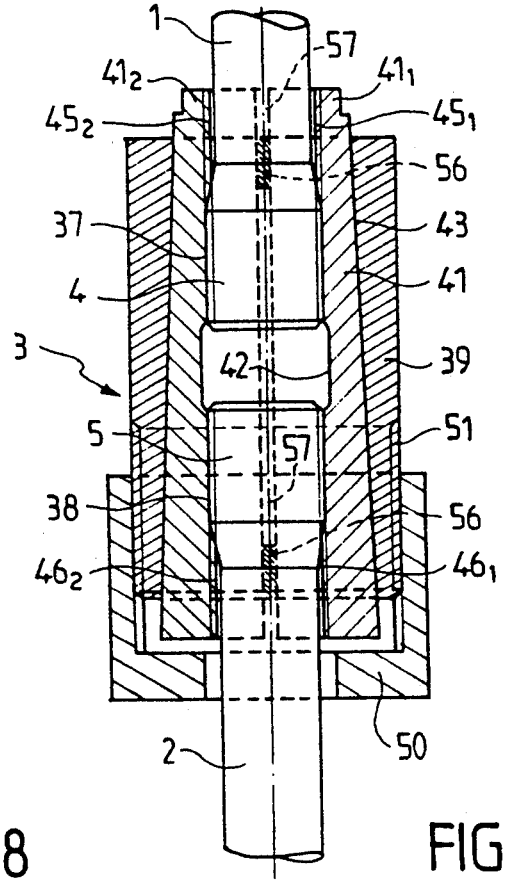
FIG. 9 is a schematic cross-sectional view of a sixth form of embodiment of a mechanical connection for reinforcing rods according to the present invention.

This being the case, the present invention provides other forms of embodiment of mechanical connection, based on the same principle, as illustrated in FIGS. 7, 8 and 9.

In this case, sleeve 3 is constituted by a sheath having a conical bore, 29; 39, inside which is provided a socket 31; 41 in several conical portions, the outer face 33; 43 of which allows it to be rotated and to be longitudinally locked in relation to sheaths 29; 39 and the internal bore 32; 42 of which has the said first and second tapped portions 27, 38; 37, 38, in this case with opposed threads.

Such a sleeve comprises the said means for allowing the end 4 of the first rod 1 to be passed completely through sheath 29; 39 as well as for allowing the sheath 29; 39 to be rotated about the end of the said first rod 1 and, simultaneously, screwed, directly or indirectly, onto end 5 of second reinforcing rod 2. In this case, the ends of the first and second rods are placed substantially coaxially, substantially end to end, and rotationally immobile.

Furthermore, in accordance with the above description, the said first and second tapped portions 27, 28; 37, 38 must provide for a possibility of rotation in relation to sleeve 3 and permit longitudinal deflection to adjust for the threads of the two said ends 4 and 5.

To allow this, conical socket 31; 41 placed in the conical bore corresponding to sheath 29; 39 is made in several portions and takes the form, notably, of at least two shell halves $31_1$ and $31_2$; $41_1$ and $41_2$ suitable for being placed on either side of ends 4 and 5 of the said first and second rods 1, 2 and for emprisoning them when they are placed in sheath 29; 39, as shown, in particular, in FIGS. 11 and 12 in the case of the embodiment of FIG. 7.

The said shell halves $31_1$, $31_2$; $41_1$, $41_2$ have a conical external face complementary to face 33; 43 of sheath 29; 39. Furthermore, the said shell halves have on the internal portion, in each end area, a tapped portion $35_1$, $35_2$, $36_1$, $45_1$, $45_2$, $46_1$, $46_2$.

If it is assumed that end 4 of the first reinforcing rod has a right-hand thread, the said first tapped portion 27; 37 will thus have a right-hand thread and will be substantially constituted by a right-hand tapped portion on each of the shell halves $35_1$, $35_2$; $45_1$, $45_2$. In this case, the other end, 5, of the second reinforcing rod will have a left-hand thread and the said second tapped portion 28; 38 will be substantially formed by a left-hand tapped portion provided on each shell half $36_1$, $36_2$; $46_1$, $46_2$.

The said tapped portions of the shell halves have technical characteristics that are adapted to the threaded portions of the said ends so that they can be placed around them and form, as it were, a nut for the threaded ends.

In this respect, the two shell halves $31_1$, $31_2$; $41_1$, $41_2$ are spaced apart by a gap 53, 57 and positioned by adjusting spacers 54; 55; 56 allowing the threads of the two shell halves to be tightened on the threads of the ends of the rods.

Such an arrangement permits the shell halves $31_1$, $31_2$; $41_1$, $41_2$ to be put into place on the ends 4, 5 of the two rods in question, 1, 2, substantially coaxially, substantially end to end and rotationally immobile.

Indeed, the presence of a right-hand thread and of a left-hand thread makes it possible to increase or to decrease the distance between the threads of the first end and of the second end, and whatever their correspondence. In other words, when the ends are positioned opposite one another, a shell half $31_1$; $41_1$ is placed on ends 4 and 5 and the shell half is rotated about the ends to find the position in which the threads $35_1$; $45_1$ coincide with those, 27; 37, of end 4 and threads $36_1$; $46_1$ coincide with those, 28; 38, of end 5.

Then, once this position has been found, the other shell half $31_2$; $41_2$ and adjusting spacers 54; 55; 56 are placed opposite. Socket 31 is then formed. It then has to be rendered integral with ends 4, 5 and, for this purpose, it is then fitted into sheath 29; 39, which will have been passed previously around end 4.

To allow the shell halves to be locked in the sleeve, hence rotationally and translationally immobilized, in the case shown in FIGS. 7 and 8, the two shell halves $31_1$, $31_2$ further possess an external threaded portion 40 suitable for cooperating with a corresponding tapped portion provided in the bore of sheath 29.

Furthermore, to enable the connection to be tightened, socket 31 and sheath 29 are provided with independent gripping means, notably constituted by points for engagement by any type of spanner, these points being constituted, for example, by orifices or flats.

In the case illustrated in FIG. 9, the locking of shell halves $41_1$, $41_2$ in sheath 39 is permitted by a nut 50, suitable for cooperating with a corresponding threaded portion 51 provided externally on sheath 39 which, when it is screwed, will act on the two shell halves $41_1$ and $42_2$ to push them towards the interior of sheath 39 and thus form a wedging system.

In the case represented in FIGS. 7 to 9, the different threads are freely determined, with the exception of the internally threaded portions of the shell halves $35_1$, $35_2$; $36_1$, $36_2$; $45_1$, $45_2$, $46_1$, $46_2$. Indeed, for the same socket, two threaded portions of opposed thread are required on either side: for example, a right-hand thread for rod N°. 1 and threaded portion 35; 45 and a left-hand thread for rod N°. 2 and threaded portion 36; 46.

In the case of the connections represented in FIGS. 7, 8 and 9, their implementation is as follows:

end 4 of the first rod 1 for connection is passed completely through sleeve 3 and, more precisely, sheath 29; 39, ends 4, 5, rotationally immobile, of the said first and second rods 1, 2 are placed substantially coaxially, substantially end to end, the said ends of the first rods and the second rods are positioned by rotating the said first and second tapped portions 7, 8 around the ends, firstly by means of a first shell half and then by positioning the other shell half, sheath 29; 39 is passed over socket 31; 41 thus formed and sheath 29; 39 is screwed onto socket 31; 41 by means of threaded portion 40, or possibly via nut 50, the shell halves being thus maintained, they are screwed onto the ends to place the threads under tension, sheath 29; 39 continues to be screwed until the connection is completely locked and socket 31; 41 is rotationally immobilized in relation to sheath 29; 39.

Other embodiments of the present invention, within reach of a man of the art, could, of course, be contemplated without thereby departing from the scope of the said invention.

What is claimed is:

1. A mechanical connection, particularly for application in the field of concrete element construction, comprising:

a first reinforcing rod comprising a first threaded end, said first reinforcing rod further comprising protuberances on an external surface thereof;

a second reinforcing rod comprising a second threaded end, said second reinforcing rod further comprising protuberances on an external surface thereof;

a connecting sleeve having a first tapped portion for receiving said first threaded end of said first reinforcing rod, and a second tapped portion for receiving said second end of said second reinforcing rod, and means for allowing said connecting sleeve to be rotated around said first end while simultaneously threadedly engaging said second end on said second reinforcing rod, so that said first and second ends are positioned substantially coaxially and in substantially end-to-end relationship, and are rotationally immobile with respect to one another, at least one of said first and second tapped portions is rotatable with respect to said sleeve, and at least one of said first and second tapped portions permits longitudinal deflection to adjust said threads of said first and second ends; and said connecting sleeve comprising a sheath having a conical bore therein, and a conical socket positioned in said conical bore, said conical socket comprising a plurality of conical socket members having external portions enabling longitudinal rotation and blockage with respect to said sheath, said conical socket members together providing a threaded inner bore comprising said first tapped portion and said second tapped portion, wherein said first and second tapped portions have opposed threads.

2. The mechanical connection according to claim 1, wherein at least one member selected from the group consisting of said first end of said first reinforcing rod, and said second end of said second reinforcing rod, are reinforced by upsetting, and wherein said mechanical connection is designed so that said connecting sleeve can be screwed completely over said end reinforced by upsetting, despite the presence of said protuberances.

3. The mechanical connection according to claim 1, wherein said first and second ends of said first and second reinforcing rods are cold upset, said first end having a diameter $d_{11}$ so that a bottom thread diameter $d_{12}$ of a threaded portion of said first end is greater than or equal to an outside diameter $\Phi C_1$ of said first reinforcing rod, including said protuberances, and said second end having a diameter $d_{21}$ so that a bottom thread diameter $d_{22}$ of a threaded portion of said second end is greater than or equal to an outside diameter $\Phi C_2$ of said second reinforcing rod, including said protuberances.

4. The mechanical connection according to claim 1, wherein said socket and said sheath have independent gripping means enabling the connection to be tightened.

5. A connecting sleeve for connecting concrete reinforcing rods, comprising a first tapped portion for receiving a first tapped end of a first reinforcing rod, and a second tapped portion for receiving a second end of a second reinforcing rod, and means to allow said connecting sleeve to be rotated around said first end while simultaneously threadedly engaging said second end on said second reinforcing rod, so that said first and second ends are positioned substantially coaxially and in substantially end-to-end relationship, and are rotationally immobile with respect to one another, at least one of said first and second tapped portions is rotatable with respect to said sleeve, and at least one of said first and second tapped portions permits longitudinal deflection to adjust said threads of said first and second ends; and said connecting sleeve comprising a sheath having a conical bore therein, and a conical socket positioned in said conical bore, said conical socket comprising a plurality of conical socket members having external portions enabling longitudinal rotation and blockage with respect to said sheath, said conical socket members together providing a threaded inner bore comprising said first tapped portion and said second tapped portion, wherein said first and second tapped portions have opposed threads.

6. The sleeve according to claim 5, wherein said socket comprises at least two shell halves suitable for placement on either side of said ends of said first and second rods and for imprisoning said ends of said first and second rods when said ends are placed in said sheath, said socket being complementary to said sheath, and said socket having a right-hand tapped portion and a left-hand tapped portion, corresponding to the threaded portions of said first and second ends of said rods.

7. The sleeve according to claim 6, wherein the shell halves are spaced apart by a gap and positioned by adjusting spacers allowing the tightening of the threads of the two shell halves on the threads of the ends of the rods.

8. The sleeve according to claim 7, wherein the sheath comprises at least one member selected from the group consisting of an internal tapped portion and an external threaded portion suitable for cooperating with the shell halves, so that the shell halves can be locked in the sheath and rotationally and translationally immobilized.

9. A process of making a mechanical connection for connecting at least a first reinforcing rod comprising a first threaded end and protuberances on the external surface thereof, and a second reinforcing rod comprising a second threaded end and protuberances on the external surface thereof, the process comprising:

passing said first end of said first reinforcing rod completely through a sleeve comprising a first tapped portion for receiving said first reinforcing rod, and a second tapped portion for receiving said second reinforcing rod;

placing the ends of the first and second reinforcing rods in a substantially coaxial position with respect to one another, and in substantially end-to-end relationship;

connecting the first reinforcing rod and the second reinforcing rod by rotating said sleeve about said first end of said first reinforcing rod, and screwing said sleeve onto said second end of said second reinforcing rod, said first and second tapped portions on said sleeve corresponding respectively to said threaded ends of said first and second reinforcing rods, at least one of said first and second tapped portions being rotatable with respect to said sleeve, and at least one of said first and second tapped portions permits longitudinal deflection to adjust said threads of said first and second ends, said sleeve comprising a sheath having a conical bore therein, and a conical socket positioned in said conical bore, said conical socket comprising a plurality of conical socket members having external portions enabling longitudinal rotation and blockage with respect to said sheath, said conical socket members together providing a threaded inner bore comprising said first tapped portion and said second tapped portion, wherein said first and second tapped portions have opposed threads.

10. The process according to claim 9, wherein the positioning of said ends of said first and second reinforcing rods are adjusted by rotating at least one member selected from the group consisting of said first tapped portion and said second tapped portion, and locking at least one of the tapped portions in said sleeve when the connection is screwed.

11. The process according to claim 9, wherein said first end of said first reinforcing rod is subjected to upsetting so that said first end comprises an upset portion having a diameter equal to or greater than an outside diameter $\Phi C_1$ of said first rod including said protuberances, and wherein the threading of said first end is carried out over said upset portion of said first end.

12. The process according to claim 9, wherein the threaded portion of said end of said first rod extends over protuberances on said first rod.

13. The process according to claim 9, wherein said first end of said first reinforcing rod is rotationally immobile, and is passed completely through said sheath portion of said sleeve, and a first conical socket member and a second conical socket member are positioned over said first and second ends of said reinforcing rods, said first and second conical socket members corresponding as shell halves of said conical socket, following which said sheath is passed over said conical socket, and said conical socket is thereafter screwed further into said first and second ends, so that said reinforcing rods are placed under tension.

14. The process according to claim 13, wherein the sheath is screwed onto the socket until said mechanical connection is locked and said socket is rotationally immobilized in relation to said sheath.

* * * * *